US007121322B2

(12) United States Patent
Marti et al.

(10) Patent No.: US 7,121,322 B2
(45) Date of Patent: Oct. 17, 2006

(54) STRIP-CASTING MACHINE FOR PRODUCTION OF A METAL STRIP

(75) Inventors: Heinrich Marti, Forch (CH); Jacques Barbé, Tarantaise (FR)

(73) Assignees: Main Management Inspiration AG, Hergiswil (CH); SMS Demag AG, Dusseldorf (DE)

( * ) Notice: Subject to any disclaimer, the term of this patent is extended or adjusted under 35 U.S.C. 154(b) by 10 days.

(21) Appl. No.: 10/380,440

(22) PCT Filed: Sep. 19, 2001

(86) PCT No.: PCT/CH01/00573

§ 371 (c)(1),
(2), (4) Date: Jun. 17, 2003

(87) PCT Pub. No.: WO02/24379

PCT Pub. Date: Mar. 28, 2002

(65) Prior Publication Data

US 2004/0040689 A1 Mar. 4, 2004

(30) Foreign Application Priority Data

Sep. 19, 2000 (EP) ..... PCT/EP00/09158

(51) Int. Cl.
*B22D 11/06* (2006.01)

(52) U.S. Cl. ..... 164/428; 164/480

(58) Field of Classification Search ..... 164/428, 164/480

See application file for complete search history.

(56) References Cited

U.S. PATENT DOCUMENTS

| | | | | |
|---|---|---|---|---|
| 5,103,895 | A * | 4/1992 | Furuya et al. | 164/475 |
| 5,590,701 | A * | 1/1997 | Fukase | 164/415 |
| 5,601,139 | A * | 2/1997 | Remy | 164/463 |
| 5,960,856 | A * | 10/1999 | Blejde et al. | 164/480 |

FOREIGN PATENT DOCUMENTS

| | | |
|---|---|---|
| EP | 0409645 | 1/1991 |
| EP | 0714716 | 6/1996 |
| EP | 0780177 | 6/1997 |
| WO | 9402269 | 2/1994 |
| WO | 9734718 | 9/1997 |

OTHER PUBLICATIONS

Patent Abstracts of Japan, vol. 011, No. 278 (M-623), Sep. 9, 1987 & JP 62 077151 A (Nippon Steel Corp), Apr. 9, 1987.
Patent Abstracts of Japan, vol. 016, No. 129 (M-1228), Apr. 2, 1992 & JP 03 291135 A (Nippon Steel Corp), Dec. 20, 1991.

* cited by examiner

*Primary Examiner*—Kuang Y. Lin
(74) *Attorney, Agent, or Firm*—Friedrich Kueffner

(57) ABSTRACT

The invention relates to a strip-casting machine for production of a metal strip, comprising two adjacent case-width casting rollers (22, 24), forming a casting gap (15'), with side seals (25) arranged on the front face thereof. The rotating casting rollers are mounted on a machine mount (32). Between the above and the side seals (25), the metal melt, introduced by means of at least one casting tube (13), or similar, is protected by at least one gaseous medium. At least said casting rollers (22, 24) are surrounded on at least the case width and front face thereof as well as the side seals by a preferably multi-component housing (30, 60, 80). An optimal sealing of the casting rollers as well as the metal strip and the metal strip appearing from between the rollers can thus be achieved in a simple manner.

5 Claims, 3 Drawing Sheets

STRIP-CASTING MACHINE FOR PRODUCTION OF A METAL STRIP

BACKGROUND OF THE INVENTION

The invention pertains to a strip-casting machine for the production of a metal strip with two adjacent casting rolls with lateral surfaces of a certain width which form a casting gap between them, the end surfaces of the rolls being provided with side seals, the rolls being rotatably supported on a machine stand and driven by at least one motor, where the metal melt is supplied through at least one casting tube or the like to the area between the casting rolls and the side seals, and is protected by at least one gaseous medium.

In a strip-casting machine of the generic type in question according to the publication WO-A-97/34,718, the horizontally mounted casting rolls are supported in a machine frame, which carries the rolls; a distribution vessel rests on the frame. To seal off the surface of the metal bath, a plate is provided over the bath, approximately parallel to its surface, which seals off the two casting rolls. Underneath the casting rolls are separate wall parts, which adjoin the machine frame, and a multipart box, which is adjacent to the wall parts. The strip emerges from this box. The disadvantage of this strip-casting machine is the relatively complicated design used to seal off the metal bath and/or the metal strip produced.

In another known twin-roll strip-casting machine according to the publication EP-A-0 780 177, a box-like container is provided to seal off the solidified metal strip emerging underneath from the gap between the casting rolls. The walls of this container extend all the way to the bottom parts of the outer jackets of the casting rolls, where a seal is created by a sealing element. This type of seal, however, is relatively complicated in design and expensive to maintain and also entails undesirable contact between the sealing element and the rotating casting roll. When leaks occur, there is the danger that scale can form on the metal strip, which lowers the quality of the product.

SUMMARY OF THE INVENTION

Against this background, the present invention was based on the task of creating a strip-casting machine of the generic type indicated above, by means of which both the metal bath or the produced metal strip and the casting rolls can be sealed off satisfactorily from the ambient air and also so that the operation and maintenance of the machine can be simplified.

The task is accomplished according to the invention in that a preferably multipart housing encloses at least the lateral surfaces and ends of the casting rolls and the side seals.

With this design of the strip-casting machine according to the invention, it is easy to achieve an optimum seal for both the metal bath present between the rolls and the metal strip emerging underneath from between the casting rolls.

The casting rolls and the side seals, however, can nevertheless be made accessible quickly and easily for the purpose of repair and maintenance, as a result of which the output of the machine can be increased.

In a highly advantageous design, the housing for the metal strip emerging underneath from the casting gap between the casting rolls is adjoined by a longitudinal housing with a chamber, where the chamber formed by the housing is connected by an opening to the adjoining chamber of the longitudinal housing.

BRIEF DESCRIPTION OF THE DRAWING

Exemplary embodiments of the invention and additional advantages offered by it are explained in greater detail below on the basis of the drawing.

DETAILED DESCRIPTION OF THE INVENTION

Figure 1:
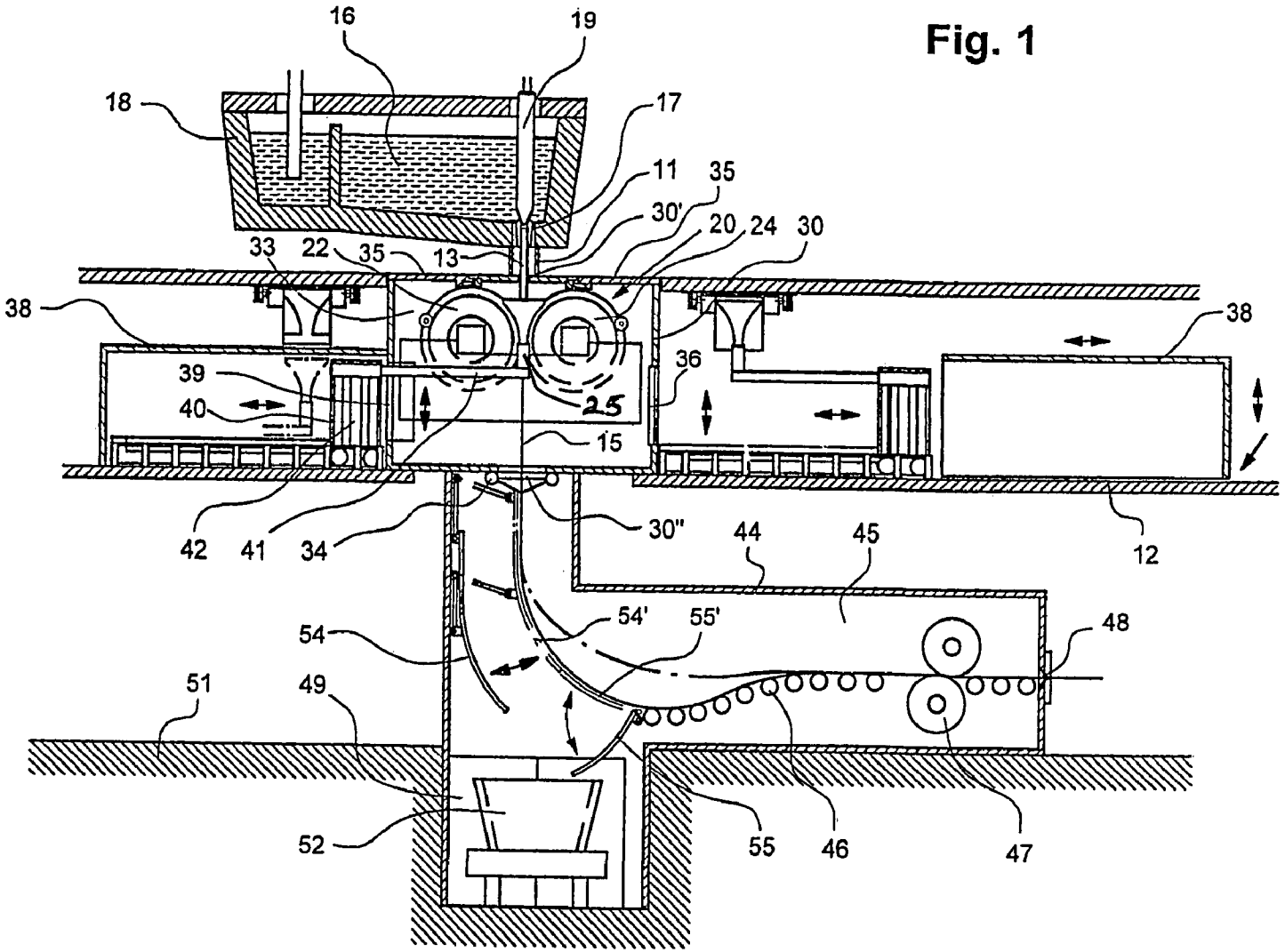
FIG. 1 shows a schematic longitudinal section through a strip-casting machine according to the invention.

FIG. 1 shows a strip-casting machine 20 for the production of a metal strip 15, especially a steel strip, which can be produced in a continuous casting process. This strip-casting machine 20 is mounted on a stage 12 and is supplied with metal melt 16 from a distribution vessel 18 installed above the machine, as is known from conventional continuous casting systems. It is advisable for the distribution vessel 18 to have a pouring opening 17, which can be closed by a stopper 19 or the like, and a casting tube 13, extending to a point between the casting rolls 22, 24, through which the melt can flow out.

The main components of this strip-casting machine 20 are the two essentially parallel casting rolls 22, 24, the axes of which are approximately horizontal. A side seal 25 is provided at each end of the rolls, as a result of which an opening is formed, which is closed on all sides and which has the casting gap 15' at the bottom. Each of the casting rolls 22, 24 is supported rotatably at each end on a machine stand 32 and is driven by a motor integrated into the stand.

According to the invention, the casting rolls 22, 24 are surrounded by a closable housing 30, which has an opening 30' in the top for the casting tube 13, which projects into the area between the casting rolls 22, 24, and an opening 30" in the bottom for the emerging metal strip 15. These openings 30', 30" are sealed, and the chamber 33 inside the housing is filled with a shielding gas, preferably an inert gas, during the casting operation. In cases where two or more casting tubes are used, it would be possible for several openings 30' to be provided in the top. These openings could be round or slot-shaped, and there does not necessarily have to be a casting tube in each one.

It is highly advantageous for this box-shaped housing 30 to be a certain distance away from the sides and the top of the casting rolls 22, 24 or from the machine stand 32, so that there is no need for the sealing elements required in the case of the casting machine according to the previously cited publication EP-A-0 780 177 to seal the metal melt off from the outside.

In the top, this housing 30 is provided with two horizontal doors 35, which are designed so that they can be slid horizontally from the closed position shown in FIG. 1 into an open position. For this purpose, they are guided laterally in appropriate rails (not shown), and it is advantageous for them to be lowered into the closed position shown so that the housing 30 can be sealed in the desired manner.

It would also be possible, however, to provide only one door, which would in any case reduce the number of gaps to be sealed. It would be advantageous for this one door to be approximately equal in size to the two doors 35 shown and to be provided with an appropriate opening 30' for the passage of melt.

In addition, the housing 30 is also provided with openings 39, which can be closed by doors 36. These openings make it possible for the side seals 25 of the casting rolls 22, 24 to be guided by manipulators 40, which are free to travel outside the housing 30 and which are thus able to remove the side seals from their operating positions shown and to take them out through these openings 39 and return them to the housing 30 again. The manipulator 40 in question has for this purpose a support arm 41 and a drive 42, which can adjust the height of the arm. The manipulator can thus be moved from an operating position to a retracted maintenance position and back again. In the operating position of the manipulator 40, the unsealed opening 39 can be sealed off by means of a separate shield enclosure 38. This shield enclosure 38 surrounds the manipulator 40 and rests tightly against the side of the housing 30. Cassettes are used to bring the side seals up into position and to carry them away.

Another advantage obtained within the scope of the invention is that the cast metal strip 15 is guided underneath the housing 30 into an additional longitudinal housing 44, which forms a chamber 45, in which a shielding gas is also present in order to protect the metal strip 15 from contact with oxygen and especially to prevent the formation of scale. In this chamber 44, several rollers 46 and compression rolls 47 are installed, so that the metal strip 15 is guided through this longitudinal housing 44 and through a sealed opening 48 in one end of the housing. After it emerges from the housing 44, the metal strip, which has cooled by this point, can be coiled up, for example, or sent on for further processing.

In addition, the longitudinal housing 44 has a pit 49 underneath the opening 30" and thus underneath the casting gap 15'. A collecting tank 52 is provided in this pit in the plant floor 51. This collecting tank 52 has the task of collecting any liquid metal which might escape from between the casting rolls in the event of a leak and thus of preventing any damage from occurring. Above this tank 52 are also swinging guide flaps 54, 55, which form a pass-through opening in the position shown, whereas in the pivoted position 54', 55' they form a guide path for the metal strip 15.

In the state of the casting operation illustrated in FIG. 1, the top opening 30' in the housing 30 is sealed off by a bellows 11 or the like, which connects the housing to the vessel 18. The sleeve-like bellows 11 surrounds the casting tube 13. The casting tube could also be omitted and the melt simply allowed to fall freely. The lower opening 30" in the housing, through which the strip 15 passes, can be sealed off by a sealing device in the form of a gas shield, for example, produced by nozzles 34. In principle, however, this sealing device could also be omitted, and the opening 30" thus could lead directly to the chamber 45.

In addition, the housing 30 has a feed line (not shown) for the injection of a shielding gas into the interior space 33. Shielding gas can also be supplied to the distribution vessel 18, which is provided with a cover. The gas introduced into the housing 30 can be cooled and returned through a gas circuit. Upon completion of the casting operation and before the housing is opened, the shielding gas can be pumped out and into a storage tank, and the air in it can be filtered out if desired.

Figure 2:
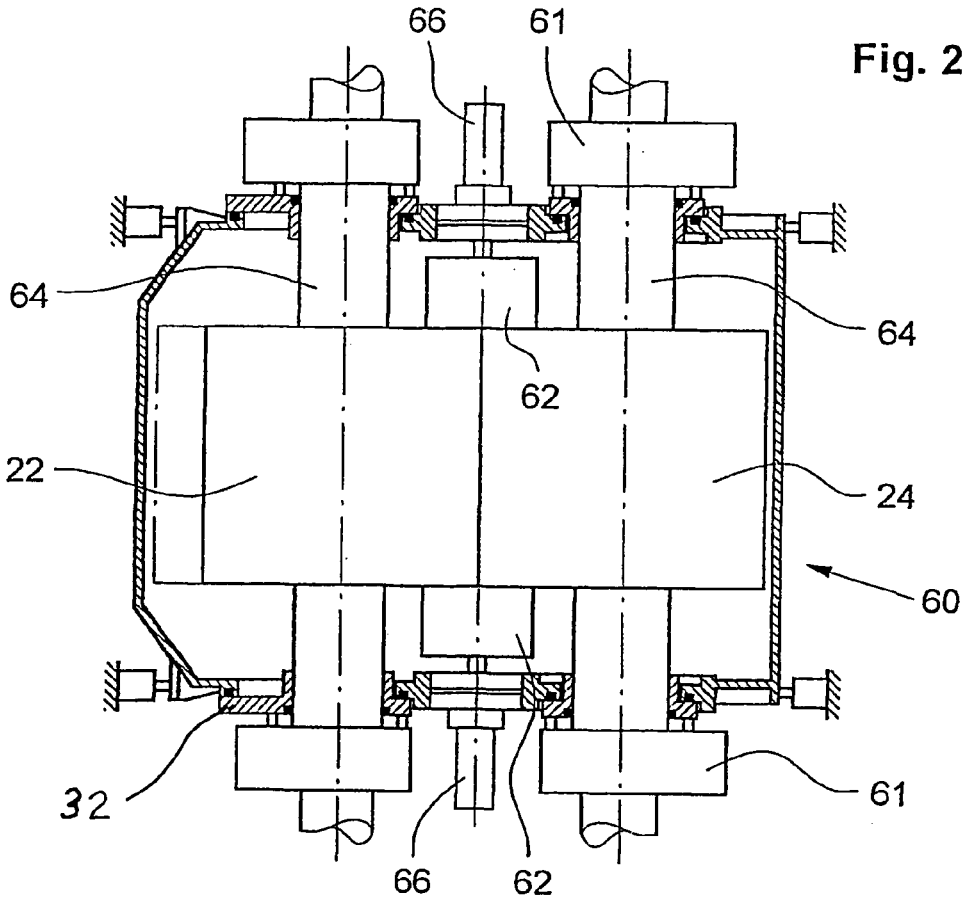
FIG. 2 shows a cross section of a housing along the axes of the casting rolls of a strip-casting machine according to the invention.
Figure 3:
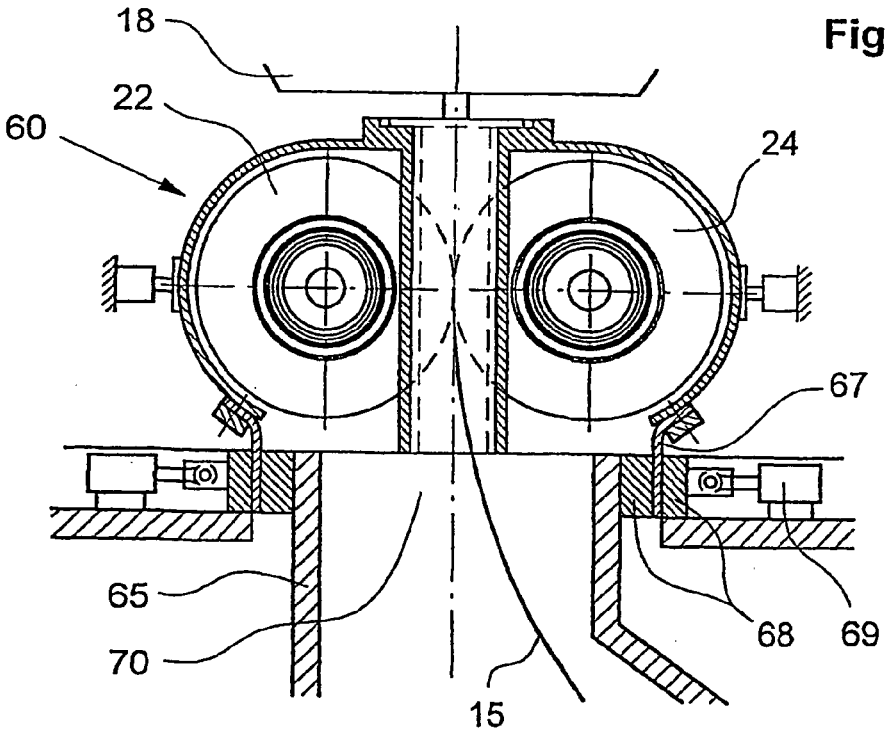
FIG. 3 shows a cross section through the housing according to FIG. 2.

FIGS. 2 and 3 show the principle of a variant of a strip-casting machine, which is designed basically in the same way as the machine according to FIG. 1. In this strip-casting machine, a housing 60 is provided, which, according to the invention, surrounds the casting rolls 22, 24. The multipart housing 60 extends around both the lateral surfaces and the ends of the rolls and thus also encloses the side seals 62. The motor stands 61 supporting the axles 64 of the casting rolls 22, 24, however, are not enclosed. The housing 60 surrounds the axles at both ends of the casting rolls and also the drive 66 of the seals 62. At the top, it is a certain distance away from the indicated melt distribution vessel 18.

The multipart housing 60 is provided with a base 67 where it meets the longitudinal housing 65; the base can be attached by fastening elements 69 to the longitudinal housing.

Between the housing 60 and the longitudinal housing 65, an opening 70 is present, which connects these two housings 60, 65 to each other. The longitudinal housing 65 is advantageously sealed all the way around and has only one sealed outlet for the cast metal strip 15.

Figure 4:
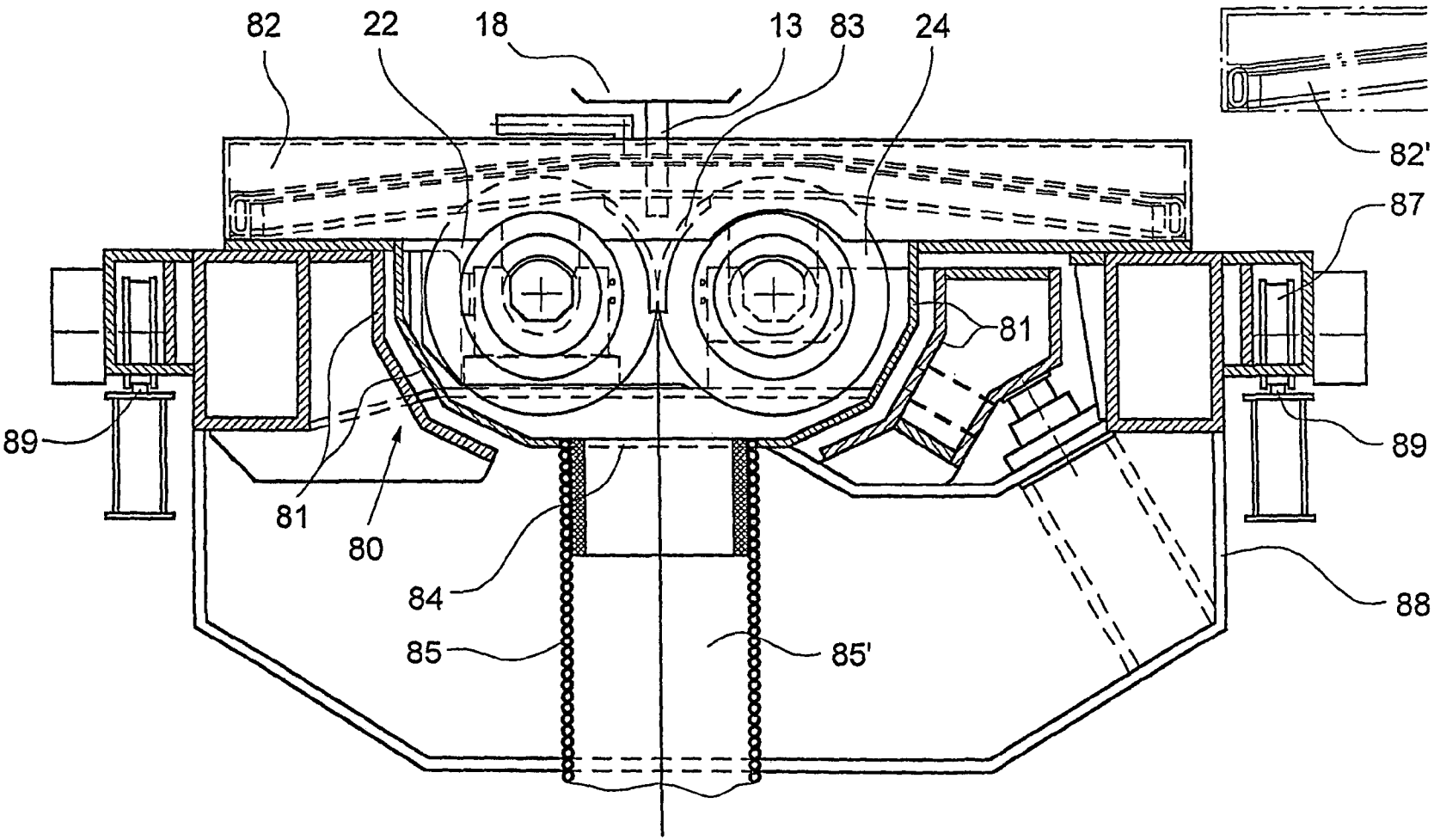
FIG. 4 shows a schematic view of another variant of a strip-casting machine.

FIG. 4 shows a strip-casting machine according to the invention, again with two casting rolls 22, 24, which are contained in a housing 80. This housing 80 consists of double side walls 81 and a cover 82, which is supported so that it can be lifted off, as indicated by the cover 82', which has been removed.

Within the scope of the invention, the housing 80 surrounds the casting rolls 22, 24 and the side seals 83. In addition, the housing has an opening 84 at the bottom, which communicates with the chamber 85' of a longitudinal housing 85. The housing 80 is positioned in a frame stand 88, which has wheels 87, which are guided on rails 89.

It is advantageous, furthermore, for both the housing 80 and the longitudinal housing 85 to be water-cooled, so that their temperature does not increase excessively during continuous operation.

With this strip-casting machine according to FIG. 4, a design which is independent of format has been created, because the housing can be made larger or smaller, depending on the diameter of the casting rolls.

The invention claimed is:

1. Strip-casting machine for the production of a metal strip with two adjacent casting rolls with lateral surfaces of a certain width which form a casting gap between them, the end surfaces of the rolls being provided with side seals, the rolls being rotatably supported on a machine stand and driven by at least one motor, where the molten metal is supplied through at least one casting tube to the area between the casting rolls and the side seals, and is protected by at least one gaseous medium, wherein a multi-part housing encloses at least the lateral surfaces and ends of the casting rolls and the side seals, the housing having an opening in the top for the casting tube extending into the area between the casting rolls and having an opening at the bottom for the metal strip emerging underneath from the casting gap between the casting rolls, the housing having at least one removable, approximately horizontal door on top, which, when closed, is directly above the casting rolls, the housing being positioned in a moveable frame stand, wherein an additional, longitudinal housing (44) is provided underneath the housing (30), this additional housing forming a chamber (45), through which the metal strip (15) is conduct, and wherein the opening (30", 70, 84) provided in the bottom of the housing (30, 60, 80) for the emerging metal strip (15) communicates with the longitudinal housing (44, 65, 85) and connects the chamber of the housing with the chamber of the longitudinal housing directly and separates them in a nearly gas-tight manner by means of a seal, and wherein the seal of the slot-shaped opening (30") in the bottom of the housing (30) consists of nozzles that provide a gas shield.

2. Strip-casting machine according to claim 1, wherein the housing (30) is box-shaped and is located a certain distance away from both the sides and the top of the casting rolls (22, 24).

3. Strip-casting machine according to claim 1, wherein a sealing system housing (60), which cooperates with casting rolls (22, 24) and the side seals, is assigned to the bottom of each of the doors (35), which sealing system housing forms a chamber above the molten metal pool between the casting rolls, this chamber being separate from the other chamber in the longitudinal housing.

4. Strip-casting machine according to claim 3, wherein the chamber formed by the sealing system housing (60) is filled with an inert gas, while the other chamber (33) in the housing is filled with another inert gas.

5. Strip-casting machine according to claim 3, wherein the housing forms a frame and is water-cooled.

* * * * *